US008276501B1

(12) United States Patent
Sukurlu

(10) Patent No.: US 8,276,501 B1
(45) Date of Patent: Oct. 2, 2012

(54) RECOIL DISSIPATION APPARATUS

(75) Inventor: John C. Sukurlu, Springfield, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 264 days.

(21) Appl. No.: 12/851,694

(22) Filed: Aug. 6, 2010

(51) Int. Cl.
*F41A 25/00* (2006.01)

(52) U.S. Cl. ..... 89/43.01; 89/1.13; 102/402; 42/94; 86/50; 901/19

(58) Field of Classification Search ..... 89/43.01, 89/42.01, 1.1, 1.13, 14.3; 42/94, 1.06; 102/402; 901/19–26; 86/50
See application file for complete search history.

(56) References Cited

U.S. PATENT DOCUMENTS 3,645,586 A * 2/1972 Piepho ..... 305/146
4,274,329 A * 6/1981 Weyer ..... 92/33
5,934,141 A * 8/1999 Costa ..... 74/89.17
6,116,136 A * 9/2000 Kirschner et al. ..... 89/43.01
6,889,594 B2 * 5/2005 Ebersole et al. ..... 89/42.01
7,895,930 B2 * 3/2011 Fisk et al. ..... 89/1.1
2003/0090113 A1 * 5/2003 Piorkowski et al. ..... 292/139
2007/0261689 A1 * 11/2007 Tai et al. ..... 124/67
2009/0159382 A1 * 6/2009 Chemouni et al. ..... 188/290
2010/0180399 A1 * 7/2010 Patzer et al. ..... 16/54
2011/0000363 A1 * 1/2011 More ..... 89/43.01

* cited by examiner

*Primary Examiner* — Bret Hayes
*Assistant Examiner* — Joshua Freeman
(74) *Attorney, Agent, or Firm* — Henry S. Goldfine

(57) ABSTRACT

A recoil dissipation apparatus may include a linear roller rail and a roller block that is translatable on the linear roller rail with only one degree of freedom. A gear rack may be located adjacent the linear roller rail. A barrel clamp may be fixed to the roller block. A pinion gear may engage the gear rack. The pinion gear may be fixed on a shaft. The shaft may have a rotary viscous damper fixed at one end. The recoil force from a barrel fixed in the barrel clamp may cause translation of the roller block and dissipation of the recoil force by the rotary viscous damper.

14 Claims, 4 Drawing Sheets

RECOIL DISSIPATION APPARATUS

STATEMENT OF GOVERNMENT INTEREST

The inventions described herein may be manufactured, used and licensed by or for the U.S. Government for U.S. Government purposes.

BACKGROUND OF THE INVENTION

The invention relates in general to recoil dissipation and, in particular, to a recoil dissipation apparatus suitable for an arm of a robot.

Explosive Ordnance Disposal (EOD) relates to disarming and/or neutralizing explosive devices. Improvised Explosive Devices (IEDs) may be neutralized with a known Percussion Actuated Neutralizer (PAN) disrupter, which may be similar to a firearm.

Current methods for employing a disputer may require the EOD operator to manually set-up the PAN disrupter. The EOD operator may be within three feet of the IED. The EOD operator may be exposed to harm because there may a nearby, alternate ambush device, or the IED may be monitored and detonated with a remote detonator. A dummy/inert IED may be used to lure the EOD operator into an area that is being watched by a sniper. The IED may be a timed IED, and the EOD operator may be there when the timed IED detonates.

Robotic operation of the PAN disrupter may not be possible on Man Transportable Robotic System (MTRS) robots due to high recoil produced by the type of charge the PAN employs. Recoil caused by a PAN disrupter hard-mounted onto MTRS robots may cause robot arm failure and robot damage. Past solutions have had shortcomings in eliminating enough recoil to allow safe, controlled deployment of the PAN disrupter on the robot arm.

One known mount uses a friction brake, which converts the recoil energy into heat via a friction clamp that allows translation of the barrel. The friction brake was determined to reduce the recoil by only 85%. Another type of mount on a similar mechanism employs a brake shoe construction that resulted in only 82% recoil reduction when mounted on a test stand. With the known mounts, the robot arm may be subject to 500 pounds or more of force when firing the PAN disrupter. A need exists for an apparatus to absorb or dissipate the recoil of a PAN disrupter that is mounted to a robot.

SUMMARY OF THE INVENTION

It is an object of the invention to provide a recoil dissipation apparatus suitable for an arm of a robot.

One aspect of the invention is a recoil dissipation apparatus. The recoil dissipation apparatus may include a linear roller rail, a roller block translatable on the linear roller rail with only one degree of freedom, a rack adjacent the linear roller rail, a barrel clamp fixed to the roller block, a pinion gear engaged with the rack and fixed on a shaft, and a rotary viscous damper fixed to the shaft.

The recoil dissipation apparatus may include a roller block buffer at one end of the linear roller rail and a barrel clamp lock at another end of the linear roller rail. The barrel clamp lock may include a magnet and the roller block buffer may include a spring.

The barrel clamp may include front and rear barrel fixtures separated by a gap. The shaft may be disposed in the gap. The pinion gear and the rotary viscous damper may be disposed on opposite sides of the barrel clamp.

The recoil dissipation apparatus may include a mount for connecting the apparatus to a second apparatus. The second apparatus may be a robot.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
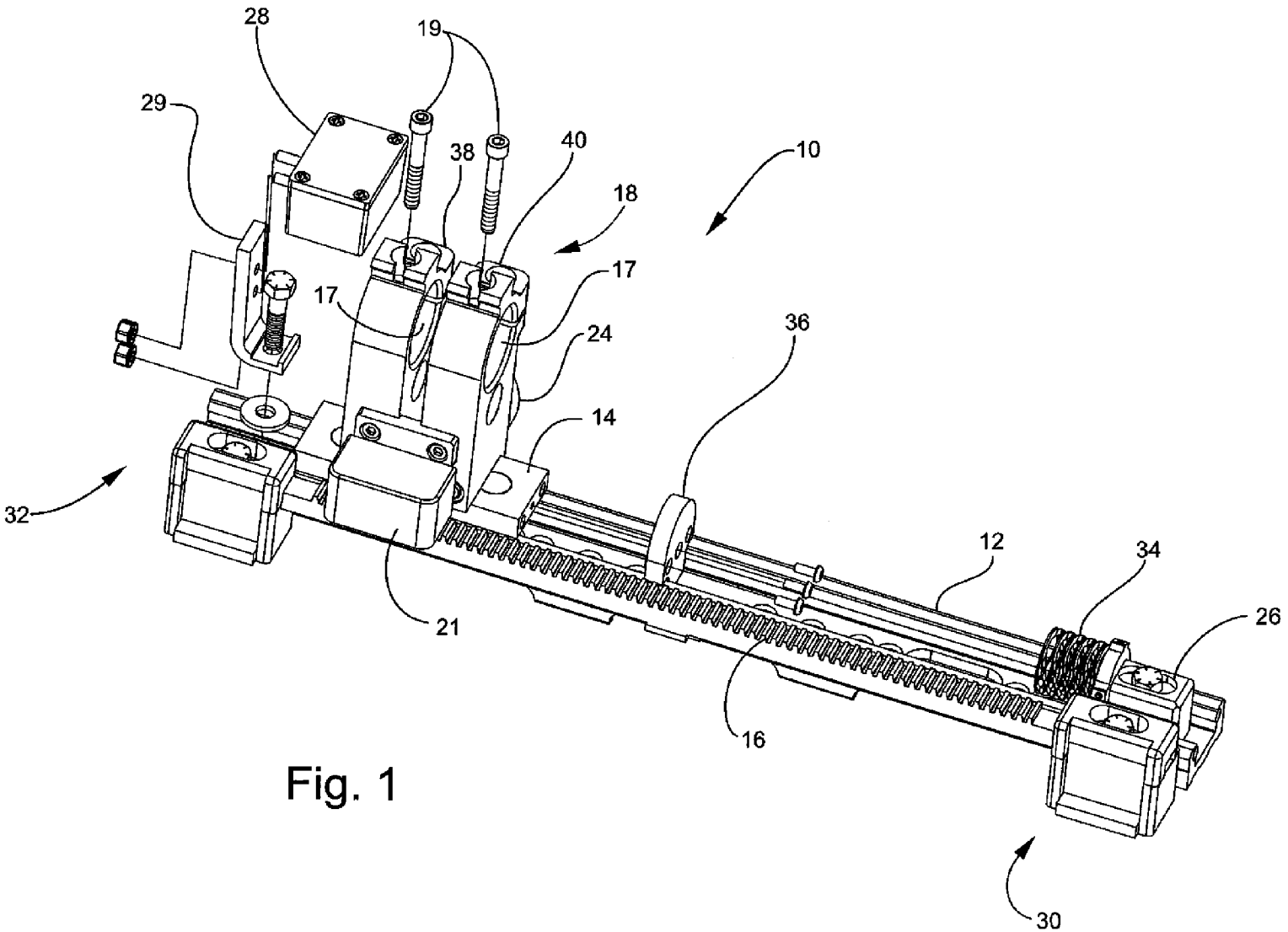
FIG. 1 is a partially exploded, perspective view of an embodiment of a recoil dissipation apparatus.
Figure 2:
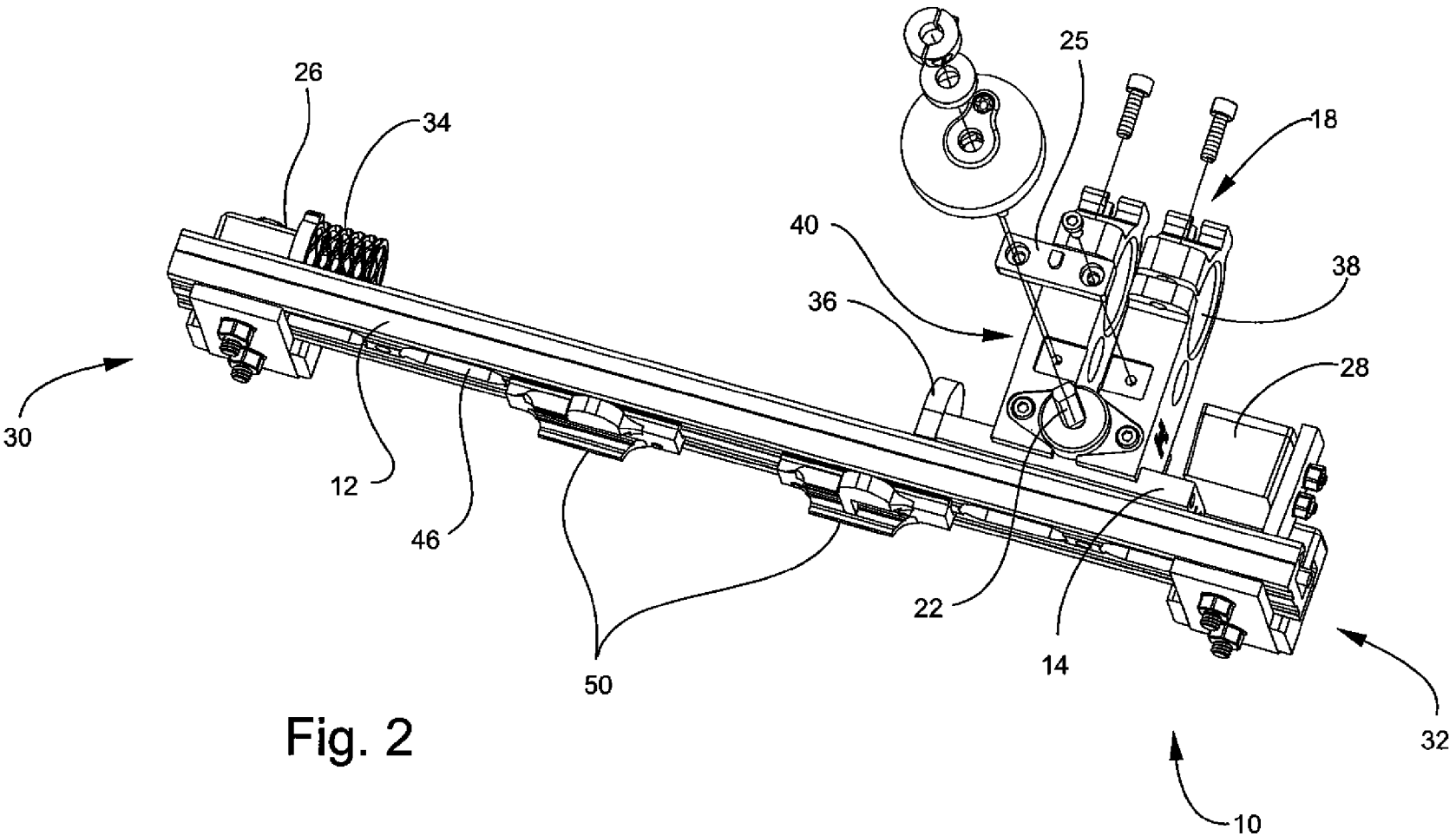
FIG. 2 is a partially exploded view of the recoil dissipation apparatus of FIG. 1 from another perspective.

Referring to FIG. 1, a recoil dissipation apparatus 10 may include a linear roller rail 12. A roller block 14 may be translatable on linear roller rail 12 with only one degree of freedom. A rack 16 may be disposed adjacent linear roller rail 12. A barrel clamp 18 may be fixed to roller block 14 using, for example, fasteners 19. The barrel of a PAN disrupter (not shown) may be fixed in barrel clamp 18. Barrel clamp 18 may include a front barrel fixture 38 and a rear barrel fixture 40 having openings 17. Front and rear barrel fixtures 38, 40 may be joined with a plate 25 (FIG. 2).

Figure 3:
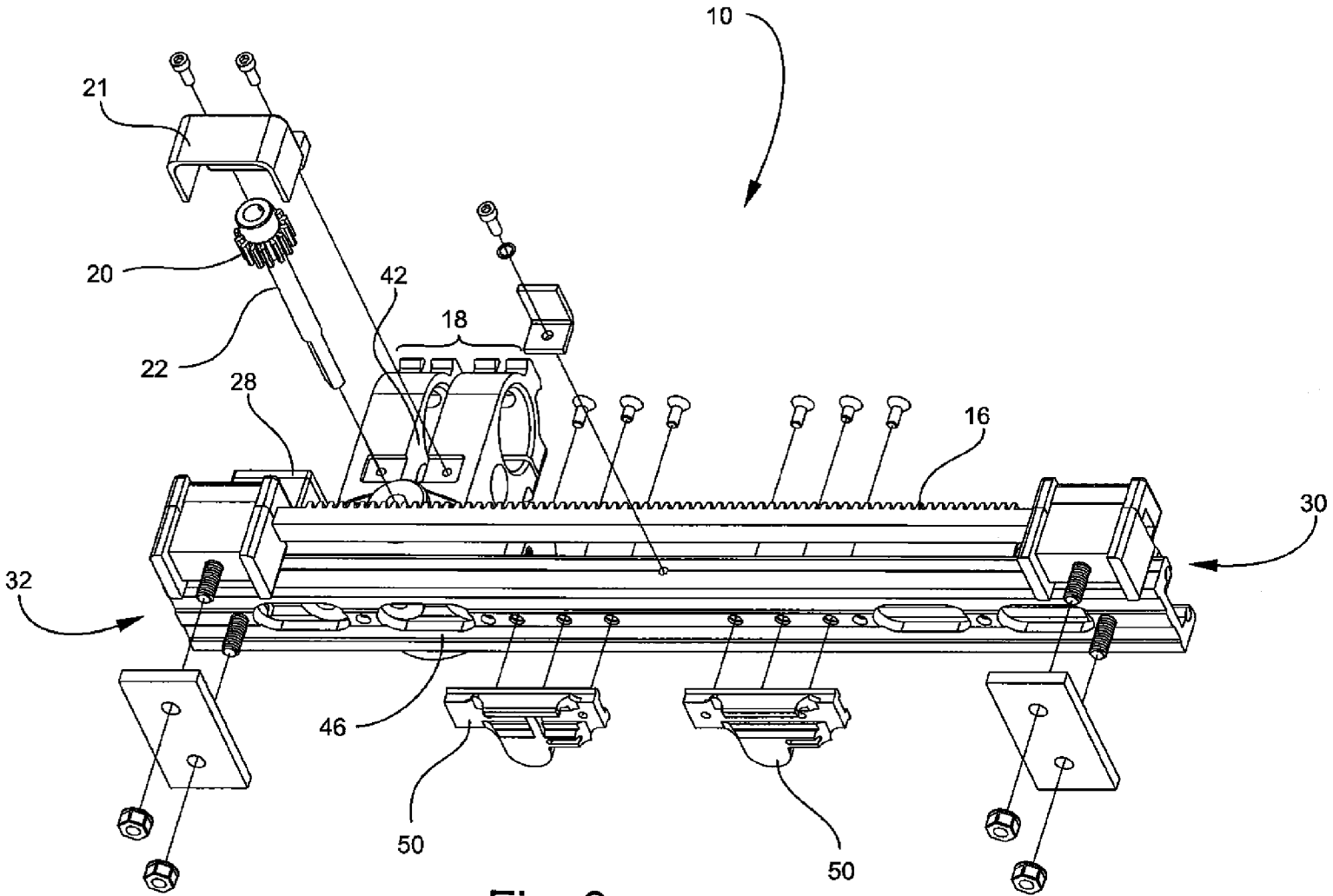
FIG. 3 is partially exploded view of the recoil dissipation apparatus of FIG. 1 from a third perspective.

Disposed inside pinion gear shield or housing 21 may be a pinion gear 20 (FIG. 3). Pinion gear 20 may be engaged with rack 16. Pinion gear 20 may be fixed on a shaft 22. A rotary viscous damper (RVD) 24 (FIG. 2) may be fixed to shaft 22.

A roller block buffer 26 (FIG. 1) may be disposed at one end 30 of linear roller rail 12. Roller block buffer 26 may include a spring 34. One end of roller block 14 may include a buffer plate 36 (shown exploded in FIG. 1) for contacting roller block buffer 26.

A barrel clamp lock 28 (shown exploded in FIG. 1) may be disposed at another end 32 of linear roller rail 12. A bracket 29 may be used to attach barrel clamp lock 28 to rail 12. Barrel clamp lock 28 may be a permanent magnet. Barrel clamp lock 28 may provide a magnetic attractive force to the barrel clamp 18 to maintain the recoil dissipation apparatus 10 in the firing position. After firing of the PAN or other firearm that may be fixed in barrel clamp 18, recoil dissipation apparatus 10 may be manually returned to the firing position.

Front and rear barrel fixtures 38, 40 may be separated by a gap 42 (FIG. 3). Shaft 22 may be disposed in gap 42. Pinion gear 20 and RVD 24 (FIG. 2) may be disposed on opposite sides of barrel clamp 18.

Figure 4:
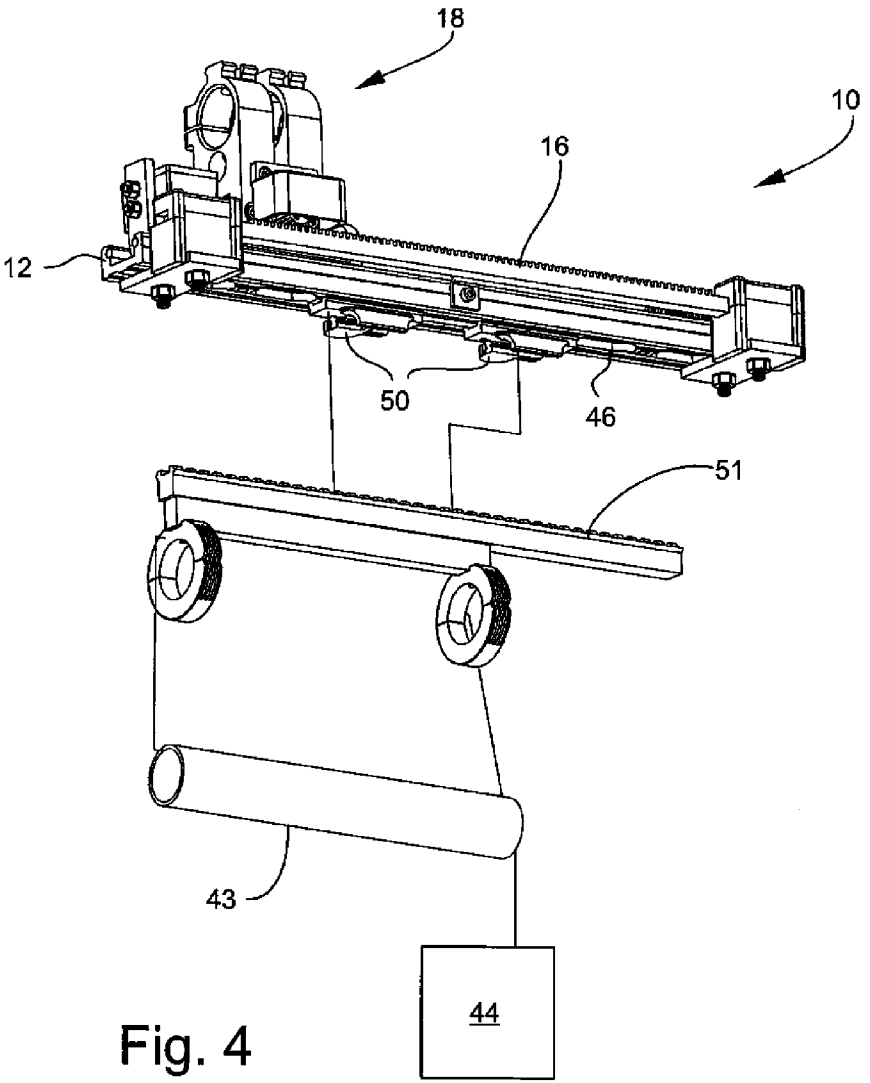
FIG. 4 is an exploded, perspective view of the recoil dissipation apparatus of FIG. 1 and a mounting interface with a schematically-shown robot.

Recoil dissipation apparatus 10 may include a mount for connecting the apparatus 10 to a second apparatus. The mount may be located on an underside 46 (FIGS. 2 and 3) of linear roller rail 12. In the embodiment shown, the mount may include a pair of grabbers 50, 50 (FIGS. 2 and 3) for connecting to a MIL-STD-1913 rail 51 (FIG. 4). The second apparatus may be, for example, a robot 44 (shown schematically) having a robot arm 43.

Figure 5:
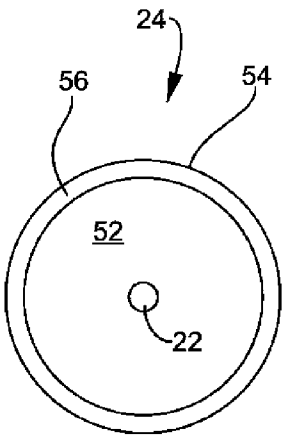
PRIOR ART Fig. 5
FIG. 5 is a schematic view of the interior of an embodiment of a rotary viscous damper.

A known RVD 24 (FIG. 5) may include a rotor 52 fixed to shaft 22, a stationary housing 54, and a fluid 56 inside the housing 54. Fluid 56 may be sheared as rotor 52 rotates. Fluid 56 may be a silicone-based fluid. A suitable fluid 56 may be, for example, Standard VV-D-1078 Polydimethylsiloxane Fluid (CAS 63148-62-9) having a kinematic viscosity of 10,000 cSt.

Barrel clamp 18 may receive a PAN barrel or another type of barrel. Barrel clamp 18 may be manually positioned so that barrel clamp lock 28 is adjacent barrel clamp 18. Barrel clamp lock 28 may hold barrel clamp 18 in the position shown in FIGS. 1 and 4 using magnetic force, for example. This is the starting position prior to firing the PAN disrupter or other firearm. When the PAN disrupter or other firearm is fired, the resulting recoil energy may be transferred into work via the motion of recoil dissipation apparatus 10.

Recoil force from the PAN or other firearm may be transmitted to barrel clamp 18 and may cause roller block 14 to translate on linear roller rail 12 and pinion gear 20 to move on rack 16. Pinion gear 20 may rotate shaft 22, which may be connected to RVD 24. Thus, linear translation of the roller block 14 may be directed into rotational work via RVD 24. The transferring of recoil energy into work may effect a reduction in the resulting force of the recoil. RVD 24 may provide smooth control. RVD 24 may provide the recoil damping by shearing fluid 56.

In testing, recoil dissipation apparatus 10 consistently reduced the felt recoil force by 99%.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A recoil dissipation apparatus, comprising:

a linear roller rail;

a roller block translatable on the linear roller rail with only one degree of freedom;

a rack adjacent the linear roller rail;

a barrel clamp fixed to the roller block;

a pinion gear engaged with the rack and fixed on a shaft; and a rotary viscous damper fixed to the shaft.

2. The apparatus of claim 1, further comprising a roller block buffer at one end of the linear roller rail and a barrel clamp lock at another end of the linear roller rail.

3. The apparatus of claim 2, wherein the barrel clamp lock comprises a magnet.

4. The apparatus of claim 2, wherein the roller block buffer includes a spring.

5. The apparatus of claim 2, wherein one end of the roller block includes a buffer plate for contacting the roller block buffer.

6. The apparatus of claim 1, wherein the barrel clamp comprises a front barrel fixture and a rear barrel fixture.

7. The apparatus of claim 6, wherein the front and rear barrel fixtures are separated by a gap and the shaft is disposed in the gap.

8. The apparatus of claim 7, wherein the pinion gear and the rotary viscous damper are disposed on opposite sides of the barrel clamp.

9. The apparatus of claim 1, further comprising a mount for connecting the apparatus to a second apparatus.

10. The apparatus of claim 9, wherein the mount is located on an underside of the linear roller rail.

11. The apparatus of claim 10, wherein the mount includes a pair of grabbers for connecting to a MIL-STD-1913 rail.

12. The apparatus of claim 9, wherein the second apparatus is a robot.

13. The apparatus of claim 1, wherein the rotary viscous damper includes a rotor fixed to the shaft, a stationary housing, and a fluid inside the housing that is sheared as the rotor rotates.

14. The apparatus of claim 13, wherein the fluid comprises silicone.

* * * * *